US010985473B2

(12) United States Patent
Leung et al.

(10) Patent No.: US 10,985,473 B2
(45) Date of Patent: Apr. 20, 2021

(54) DIELECTRIC RESONATOR ANTENNA

(71) Applicant: City University of Hong Kong, Kowloon (HK)

(72) Inventors: Kwok Wa Leung, Kowloon Tong (HK); Nan Yang, Sham Shui Po (HK); Weiwei Li, Toronto (CA)

(73) Assignee: City University of Hong Kong, Kowloon (HK)

( * ) Notice: Subject to any disclaimer, the term of this patent is extended or adjusted under 35 U.S.C. 154(b) by 0 days.

(21) Appl. No.: 16/556,499

(22) Filed: Aug. 30, 2019

(65) Prior Publication Data

US 2021/0066816 A1 Mar. 4, 2021

(51) Int. Cl.

| | |
|---|---|
| ***H01Q 1/38*** | (2006.01) |
| ***H01Q 21/24*** | (2006.01) |
| ***H01Q 21/00*** | (2006.01) |
| ***H01Q 1/50*** | (2006.01) |
| ***H01Q 9/04*** | (2006.01) |

(52) U.S. Cl.

CPC ..... *H01Q 21/24* (2013.01); *H01Q 1/38* (2013.01); *H01Q 1/50* (2013.01); *H01Q 9/045* (2013.01); *H01Q 21/0075* (2013.01)

(58) Field of Classification Search

CPC .. H01Q 1/38; H01Q 1/50; H01Q 9/04; H01Q 9/045; H01Q 9/0485; H01Q 21/0075; H01Q 21/06; H01Q 21/065; H01Q 21/24

See application file for complete search history.

(56) References Cited

U.S. PATENT DOCUMENTS

| | | | | |
|---|---|---|---|---|
| 6,067,055 | A | 5/2000 | Vaidyanathan | |
| 6,414,647 | B1 | 7/2002 | Lee | |
| 7,646,343 | B2 | 1/2010 | Shtrom et al. | |
| 7,675,474 | B2 | 3/2010 | Shtrom et al. | |
| 7,936,314 | B2 | 5/2011 | Kuramoto | |
| 8,368,609 | B2 | 2/2013 | Morrow et al. | |
| 8,988,298 | B1 | 3/2015 | Akhoondzadehasl et al. | |
| 9,461,368 | B2 | 10/2016 | Azulay | |
| 9,887,466 | B2 | 2/2018 | Ermutlu et al. | |
| 9,917,375 | B2 | 3/2018 | Korva et al. | |
| 10,148,002 | B2 | 12/2018 | McGough et al. | |
| 10,181,655 | B2 | 1/2019 | Shtrom et al. | |
| 2009/0305652 | A1* | 12/2009 | Boffa | H01Q 9/0485 455/90.3 |
| 2013/0335282 | A1* | 12/2013 | Leung | H01Q 15/244 343/756 |

OTHER PUBLICATIONS

1. W. W. Li et al, "Omnidirectional dielectric resonator antenna with a planar feed for circular polarization diversity design", IEEE Trans. Antennas Propagat., vol. 66, No. 3, pp. 1189-1197, Mar. 2018.

* cited by examiner

*Primary Examiner* — Jimmy T Vu

(74) *Attorney, Agent, or Firm* — Renner Kenner Greive Bobak Taylor & Weber

(57) ABSTRACT

A dielectric resonator antenna having a dielectric resonator element and a substrate assembly attached to the dielectric resonator element. The substrate assembly includes a feeding network arranged to: feed the dielectric resonator element to produce a first linearly-polarized omnidirectional radiation pattern at a first resonant mode, and feed the dielectric resonator element to produce a second linearly-polarized omnidirectional radiation pattern at a second resonant mode different from the first resonant mode.

26 Claims, 8 Drawing Sheets

DIELECTRIC RESONATOR ANTENNA

TECHNICAL FIELD

The invention relates to a dielectric resonator antenna, in particular, a dielectric resonator antenna that can provide different linearly-polarized omnidirectional radiation patterns.

BACKGROUND

In field of telecommunications, the use of antennas (single or multiple) to transmit/receive/transceive signals is known as antenna diversity. Antenna diversity can improve wireless communication links by mitigating multipath effect and deep fading effect, and improving channel capacity.

Various types of antenna diversity have been proposed. Examples of these include spatial diversity and polarization diversity.

In spatial diversity, multiple antennas, usually of the same characteristics, are separated by a certain distance that is preferably commensurate with the wavelength.

The antennas can use the same operation mode. This arrangement, while useful is some applications, is rather bulky and suffers from high correlation and high cost.

In polarization diversity, a dual-polarized antenna with different polarizations of is generally used, and the signals are processed independently. This arrangement offers potential for diversity combining, and can mitigate polarization mismatches that would otherwise cause signal fade.

There is a need to provide an improved or alternative antenna that can be used for (but not limited to) polarization diversity.

SUMMARY OF THE INVENTION

In accordance with a first aspect of the invention, there is provided a dielectric resonator antenna having a dielectric resonator element and a substrate assembly attached to the dielectric resonator element. The substrate assembly comprising a feeding network arranged to: feed the dielectric resonator element to produce (or receive) a first linearly-polarized omnidirectional radiation pattern at a first resonant mode; and feed the dielectric resonator element to produce (or receive) a second linearly-polarized omnidirectional radiation pattern at a second resonant mode different from the first resonant mode. The antenna can be used as a signal transmitter, a signal receiver, or a signal transceiver. The substrate assembly may be removably attached to the dielectric resonator element. Preferably, the antenna is a polarization diversity antenna.

In one embodiment of the first aspect, the first resonant mode is transverse magnetic (TM) mode. In one example, the first resonant mode is TM01δ mode. The first resonant mode may alternatively be transverse electric (TE) mode, monopole antenna mode, or loop antenna mode.

In one embodiment of the first aspect, the second resonant mode is TE mode. In one example, the second resonant mode is $TE_{01\delta+1}$ mode. The second resonant mode may alternatively be TM mode, monopole antenna mode, or loop antenna mode.

In one embodiment of the first aspect, the first resonant mode is TM mode (e.g., $TM_{01\delta}$ mode) and the second resonant mode is TE mode (e.g., $TE_{01\delta+1}$ mode). Other antenna modes are also possible.

In one embodiment of the first aspect, the substrate assembly includes a first substrate layer and a second substrate layer. The first substrate layer is arranged between the dielectric resonator element and the second substrate layer. The substrate assembly may include additional layers attached to the first and second substrate layers.

The first substrate layer and the second substrate layer may have the same cross section, thickness, or size. The first substrate layer and the second substrate layer may have the same dielectric constant.

In one embodiment of the first aspect, the feeding network is arranged between the first substrate layer and the dielectric resonator element.

In one embodiment of the first aspect, the substrate assembly further includes a ground plane arranged between the first and second substrate layers and being operably connected with the feeding network.

In one embodiment of the first aspect, the substrate assembly further includes a microstrip line network arranged on the second substrate layer on a side opposite the ground plane. The microstrip line network is operably connected with the feeding network.

In one embodiment of the first aspect, the substrate assembly further includes a feed probe extending through the first and second substrate layers, the feed probe is arranged to operably connect the feeding network with the microstrip line network.

In one embodiment of the first aspect, the feed network includes a first network portion arranged to feed the dielectric resonator element to produce the first linearly-polarized omnidirectional radiation pattern, and a second network portion arranged to feed the dielectric resonator element to produce the second linearly-polarized omnidirectional radiation pattern In one embodiment of the first aspect, the first network portion includes a patch operably connected with the ground plane and the conductive microstrip line network. The patch may be arranged centrally of the substrate assembly. The microstrip line network may include a first microstrip line for connection with a first probe or connector, and the patch is operably connected with the ground plane and with the first microstrip line.

In one embodiment of the first aspect, the patch is connected with the first microstrip line through the feed probe. The feed probe may be connected to a center of the patch. In one example, the patch includes a central circular portion and a plurality of radially extending portions extending from the central circular portion. In one example, the number of radially extending portions is an even number. Each of the plurality of radially extending portions may be connected to the ground plane through a respective via that extends through the first substrate layer. Preferably, the radially extending portions are angularly spaced apart evenly.

In one embodiment of the first aspect, the second network portion includes a plurality of arc-shaped patches arranged on a circular trajectory. The plurality of arc-shaped patches is operably connected with the ground plane and the microstrip line network. The microstrip line network may include a power combining-dividing network and a second microstrip line for connection with a second probe.

In one embodiment of the first aspect, the power combining-dividing network comprises a plurality of sections each corresponding to a respective arc-shaped patch and a combining section connecting the plurality of sections. Each of the plurality of sections and the respective arc-shaped patch may be connected through a respective via (i.e., via hole) that extends through the first and second substrate layers. Preferably, the plurality of arc-shaped patches are angularly spaced apart evenly.

Preferably, the dielectric resonator element is a solid element. The dielectric resonator element may take different form and shape, and it may be in the form of a decorative object or a functional object (e.g., light cover, mirror, decoration). The dielectric resonator element may be substantially transparent, or translucent. The dielectric resonator element may be optically-transparent. Light may pass through the dielectric resonator element. The dielectric resonator element can be made from various dielectric materials, including K9 optical glass.

In one embodiment of the first aspect, the dielectric resonator element and the substrate assembly have the same cross section or the same cross sectional shape (but different size).

In one embodiment of the first aspect, the antenna is configured for WLAN applications, e.g., 2.4 GHz WLAN Applications.

In accordance with a second aspect of the invention, there is provided an antenna having multiple ports or an antenna array having multiple antennas of the first aspect. The dielectric resonator elements of the antennas can be formed integrally. The antenna may be a multiple-port antenna, a multiple-input and multiple-output (MIMO) antenna, etc.

In accordance with a third aspect of the invention, there is provided a wireless communication device including the antenna of the first aspect. The communication device may be a satellite communication device, a Wi-Fi communication device (e.g., Wi-Fi router), etc.

In accordance with a fourth aspect of the invention, there is provided a wireless communication device including the antenna of the second aspect. The communication device may be a satellite communication device, a Wi-Fi communication device (e.g., Wi-Fi router), etc.

BRIEF DESCRIPTION OF THE DRAWINGS

Embodiments of the invention will now be described, by way of example, with reference to the accompanying drawings in which.

DETAILED DESCRIPTION OF THE PREFERRED EMBODIMENT

FIGS. 1A to 1D show a dielectric resonator antenna 100 in one embodiment of the first aspect. The dielectric resonator antenna 100 includes, generally, a cylindrical dielectric resonator element 102 and a substrate assembly 104 attached to and supporting the dielectric resonator element 102. The cylindrical dielectric resonator element 102 is a solid element with a radius of R, height of H, and dielectric constant sr. The substrate assembly 104 has a generally circular form.

Figure 1B:
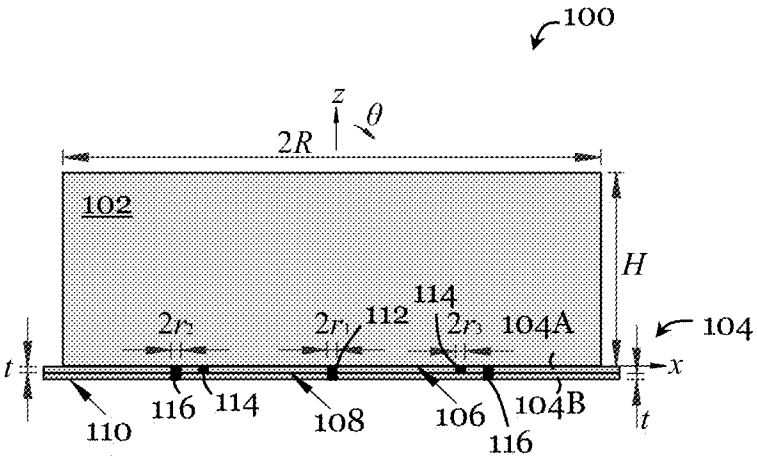
FIG. 1B is a cross sectional view of the dielectric resonator antenna of FIG. 1A (taken along line A-A of FIG. 1A)
Figure 1A:
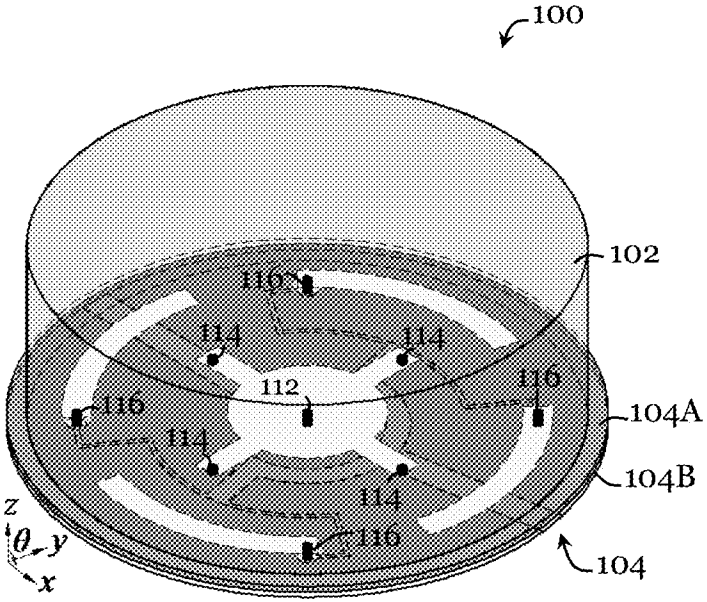
FIG. 1A is a perspective view of a dielectric resonator antenna in one embodiment of the invention.

As shown in FIGS. 1A and 1B, the substrate assembly 104 has a first substrate layer 104A and a second substrate layer 104B stacked together. The two substrate layers 104A, 104B have the same thickness of t, radius of $R_g$, and dielectric constant $\varepsilon_{rs}$. A feeding network 106, formed by metals (e.g., copper), in the form of patches/strips, is arranged between the first substrate layer 104A and the dielectric resonator element 102. As will be described in further detail below, the feeding network 106 is arranged to feed the dielectric resonator element 102 to produce (or receive), selectively or simultaneously, a first linearly-polarized omnidirectional radiation pattern at a first resonant mode and a second linearly-polarized omnidirectional radiation pattern. The first and second radiation patterns are generally the same but the polarizations are different (orthogonal to each other); the first and second resonant modes are different. In this example, the first resonant mode is $TM_{01\delta}$ mode and the second resonant mode is $TE_{01\delta+1}$ mode.

A ground plane 108, formed by metal (e.g., copper), is arranged between the first and second substrate layers 104A, 104B. The ground plane 108 is operably connected with the feeding network 106. A microstrip line network 110, formed by metal (e.g., copper), is arranged at the base of the second substrate layer 104B, on a side opposite the ground plane 108. The microstrip line network 110 is operably connected with the feeding network 106 and with the ground plane. A cylindrical feed probe 112, with a radius $r_1$ extends through the first and second substrate layers 104A, 104B, and is arranged to operably connect the feeding network 106 and the microstrip line network 110.

Referring now to FIG. 1A to 1D, the feeding network 106 includes a first network portion arranged to feed the dielectric resonator element 102 to produce the first linearly-polarized omnidirectional radiation pattern at $TM_{01\delta}$ mode. The first network portion includes a patch 106A arranged centrally on the first substrate layer 104A. The patch 106A includes a central circular portion with a radius $R_p$ and four radially extending portions extending from the central circular portion. The patch 106A is centrally-fed. The patch 106A is connected centrally with the feed probe 112 so as to be connected with a 50Ω radial microstrip line 110A of the microstrip line network 110. The radial microstrip line 110A is elongated and has a width $W_m$. The radial microstrip line 110A has a first end (near the center of the second substrate layer 104B) connected with the feed probe 112 and a second end terminating at the edge of the second substrate layer 104B for connection with an external probe or connector (the second end provides a TM port). The radially extending portions of the patch 104A are short-circuited. They each have a width of $W_p$. The end-to-end length (passing through the circular portion) of diametrically opposed radial extending portions is $2L_p$. The radially extending portions are spaced apart angularly and evenly with the same angular separation. The radially extending portions is each connected with a via 114 (i.e., via hole) at the radial-outer ends. The vias 114 extend through the first substrate layer 104A to connect with the ground plane 108.

Figure 1D:
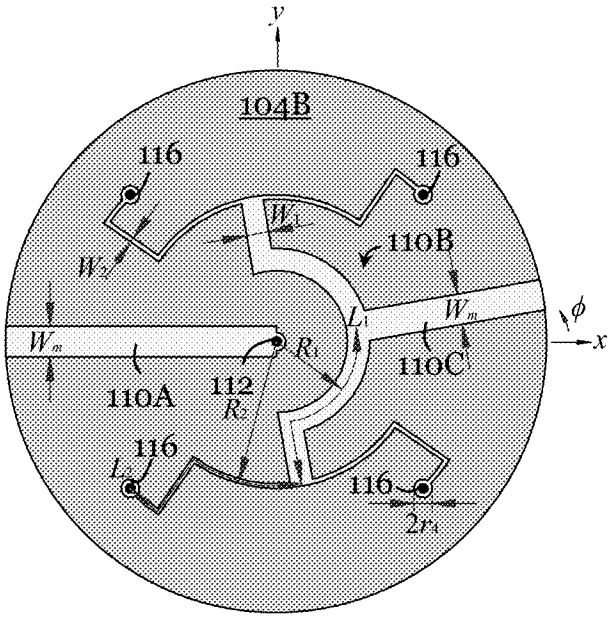
FIG. 1D is a bottom view of the substrate assembly of the dielectric resonator antenna of FIG. 1A.
Figure 1C:
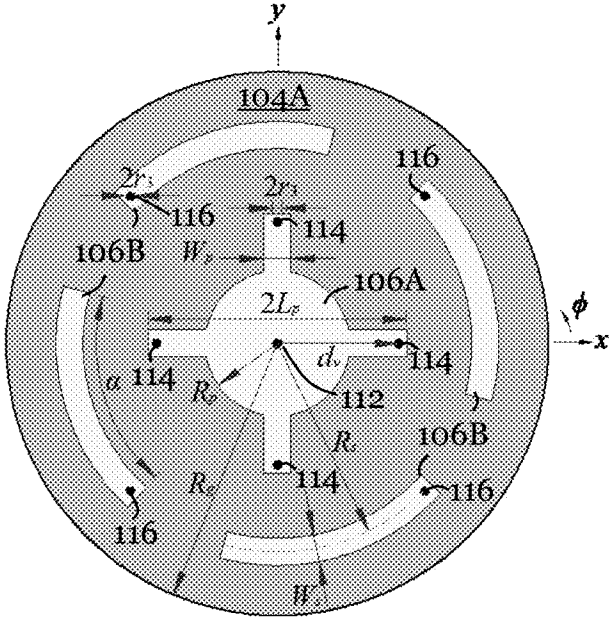
FIG. 1C is a top view of the substrate assembly of the dielectric resonator antenna of FIG. 1A.

Referring now to FIG. 1A to 1D, the feeding network 106 also includes a second network portion arranged to feed the dielectric resonator element 102 to produce the second linearly-polarized omnidirectional radiation pattern at $TE_{01\delta+1}$ mode. The second network portion includes four substantially identical arc-shaped patches 106B spaced apart angularly and evenly a circular trajectory (a virtual circle). Each of the arc-shaped patches 106B is connected at its anticlockwise end with a via 116 (e.g. via hole) that extends through the first and second substrate layers 104A, 104B. The vias 116 are connected with a power combining-dividing network 110B and a 50Ω radially extending microstrip line 110C of the microstrip line network 110. As shown in FIG. 1D, the power combining-dividing network 100B (combine and divide depending on signal flow direction) has four sections each corresponding to the respective arc-shaped patches 106B, and a combining-dividing section. The combining-dividing section, shaped like two T-junctions connected with each other, is arranged to connect the four sections with the microstrip line 110C, to combine the signals from the four sections or to split a signal into the four sections. The radial microstrip line 110C is elongated and has a width $W_m$. The radial microstrip line 110C has a first end that is spaced apart from the center of the second substrate layer 104B and a second end at the edge of the second substrate layer 104B for connection with an external probe or connector (the second end provides a TE port).

The dielectric resonator antenna 100 in this embodiment has a solid dielectric resonator element 102. In operation, the $TM_{01\delta}$ mode of the dielectric resonator antenna 100 can be excited to obtain a radiation pattern equivalent to a vertically electric-dipole-like radiation pattern; the $TE_{01\delta+1}$ mode of the dielectric resonator antenna 100 can be excited to obtain a radiation pattern equivalent to a vertically magnetic-dipole-like radiation pattern. The solid dielectric resonator element 102 can be made with K9 optical lass with a dielectric constant $\varepsilon_r$ of 6.85. The dielectric resonator antenna 100 in this embodiment is particularly adapted for 2.4 GHz WLAN applications (2.40 to 2.48 GHz).

In one example, using ANSYS HFSS, a dielectric resonator antenna with the parameters (see FIGS. 1A to 1D) can be obtained: R=31 mm, H=20.5 mm, $\varepsilon_r$=6.85, $R_g$=35 mm, t=1.524 mm, $\varepsilon_{rs}$=3.58, $r_1$=0.5 mm, $r_2$=0.5 mm, $r_3$=0.5 mm, $L_p$=15 mm, $W_p$=$_3$ mm, $R_p$=8 mm, $d_v$=14.1 mm, $\alpha$=59°, $W_s$=3 mm, $R_s$=23 mm, $W_m$=3.39 mm, $R_1$=$_9$ mm, $L_1$=21.14 mm, $W_1$=2.4 mm, $R_2$=16 mm, $L_2$=36.15 mm, $W_2$=0.5 mm, and $r_4$=1 mm.

Figure 2B:
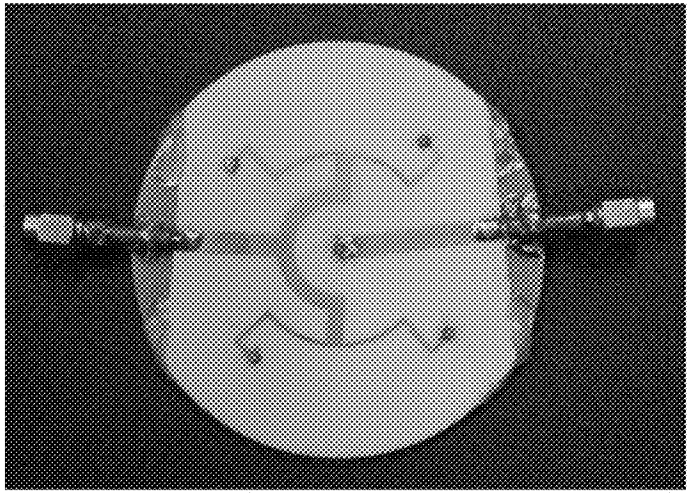
FIG. 2B is a photo showing a bottom view of the substrate assembly of FIG. 2A.
Figure 2A:
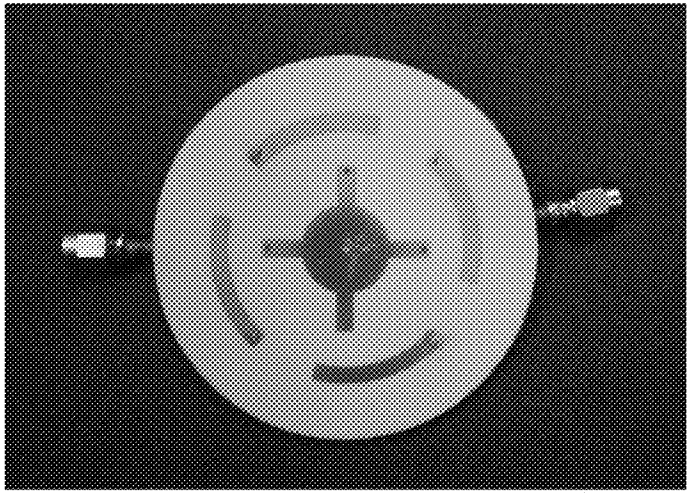
FIG. 2A is a photo showing a top view of a substrate assembly of a dielectric resonator antenna prototype in one embodiment of the invention.

A prototype has been fabricated based on the design of FIGS. 1A to 1D with these parameters. FIGS. 2A and 2B shows the top view and the bottom view of the substrate assembly of the prototype. The top view shows the feeding network pattern; the bottom view shows the microstrip line network pattern.

Figure 3:
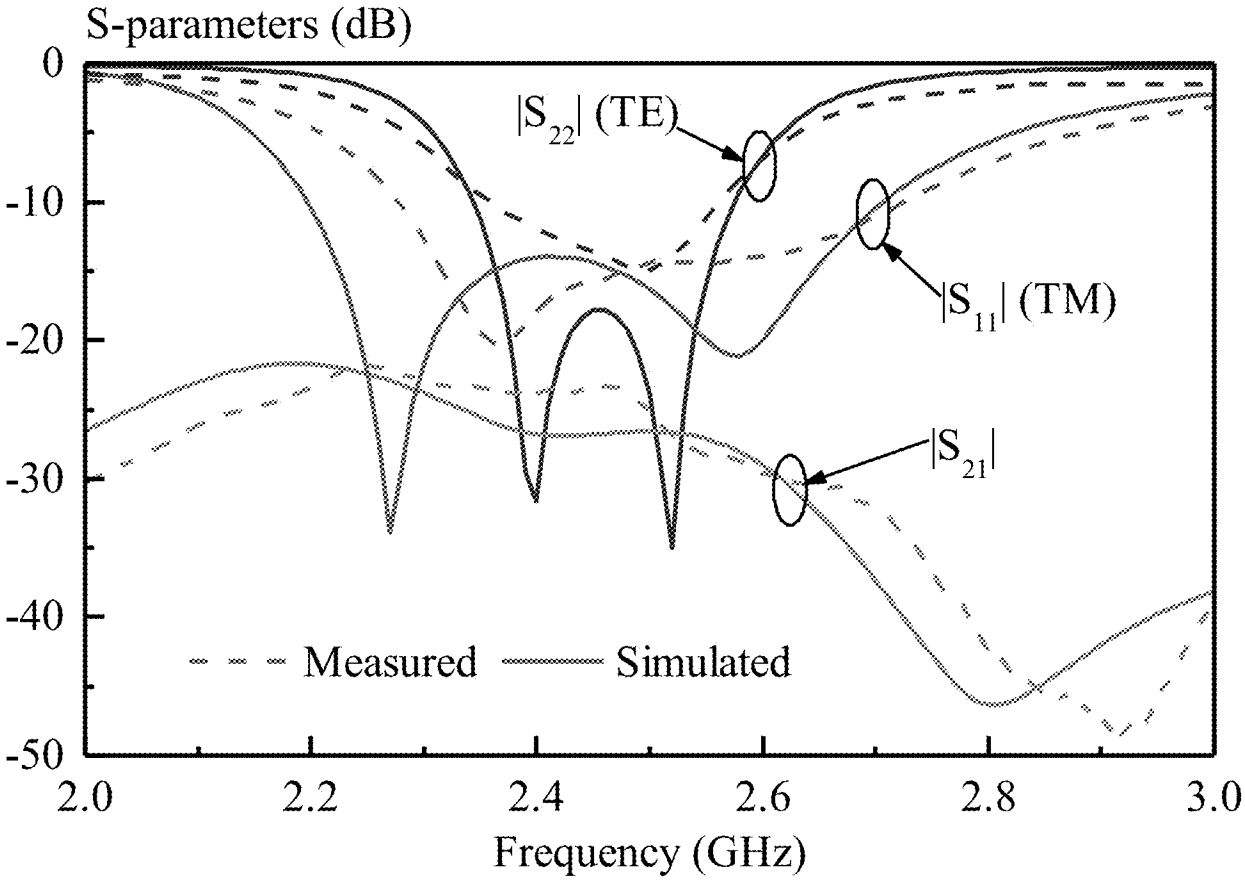
FIG. 3 is a graph showing the measured and simulated S-parameters of the dielectric resonator antenna prototype with the substrate assembly of FIG. 2A.

The prototype was tested. The S-parameters of the prototype were measured with an Agilent vector network analyzer E5071C. The simulated and measured results can be found in FIG. 3. As shown in FIG. 3, the measured reflection coefficient for the TE Port ($|S_{11}|$) is 8.1% (2.36-2.56 GHz), agreeing reasonably with the simulated 9.8% (2.34-2.58 GHz). For the TM Port, the measured reflection coefficient is 18.0% (2.28-2.73 GHz) whereas its simulated counterpart is 20.08% (2.20-2.71 GHz). Besides, the measured and simulated $|S_{21}|$ is below −20 dB from 2.0 GHz to 3.0 GHz, which is suitable for practical applications.

Figure 4A:
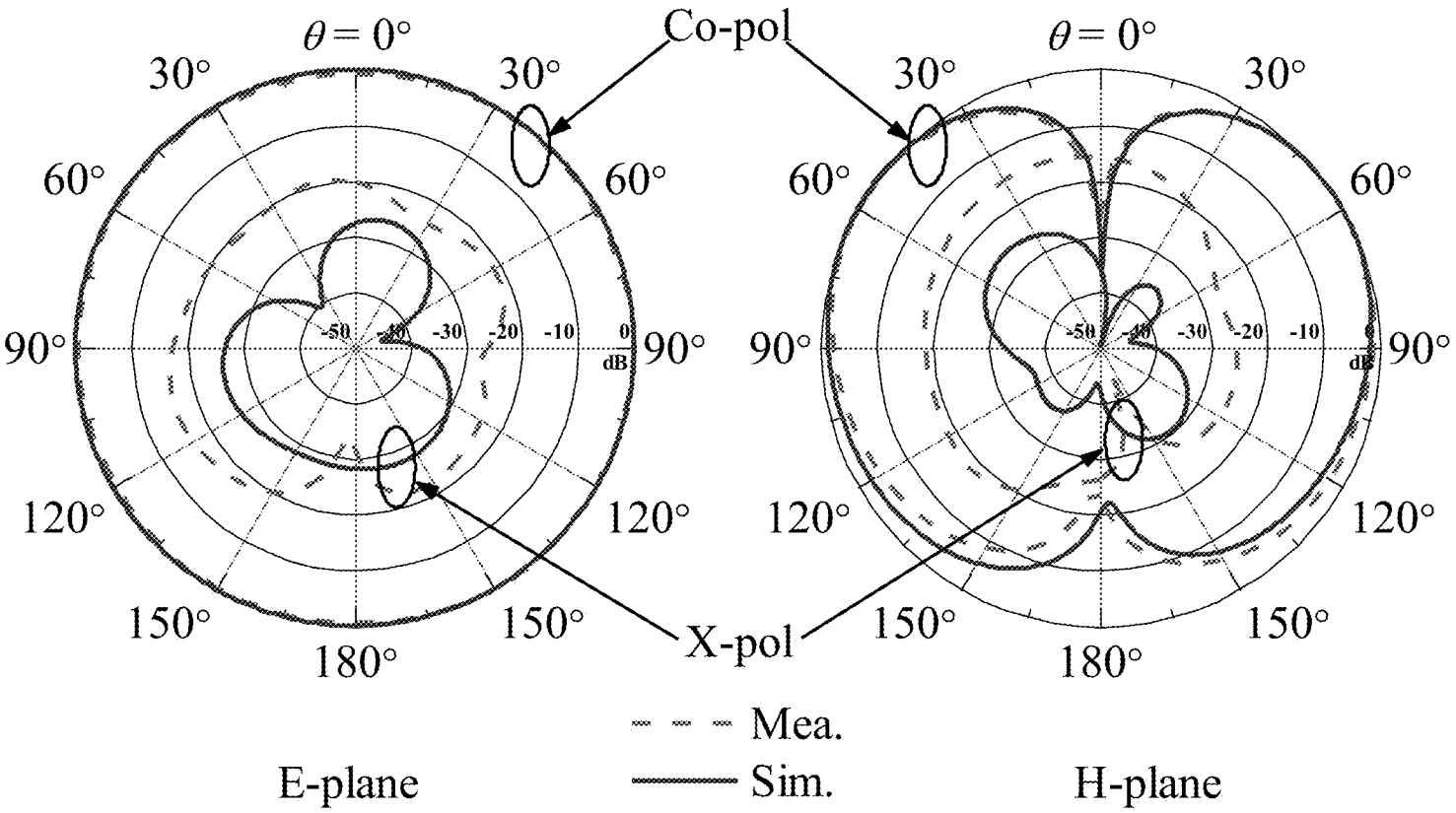
FIG. 4A is a graph showing a first radiation pattern (E-plane and H-plane, measured and simulated, at 2.44 GHz) produced by the dielectric resonator antenna prototype with the substrate assembly of FIG. 2A when connected at a first port (TE port) with a signal source.
Figure 4B:
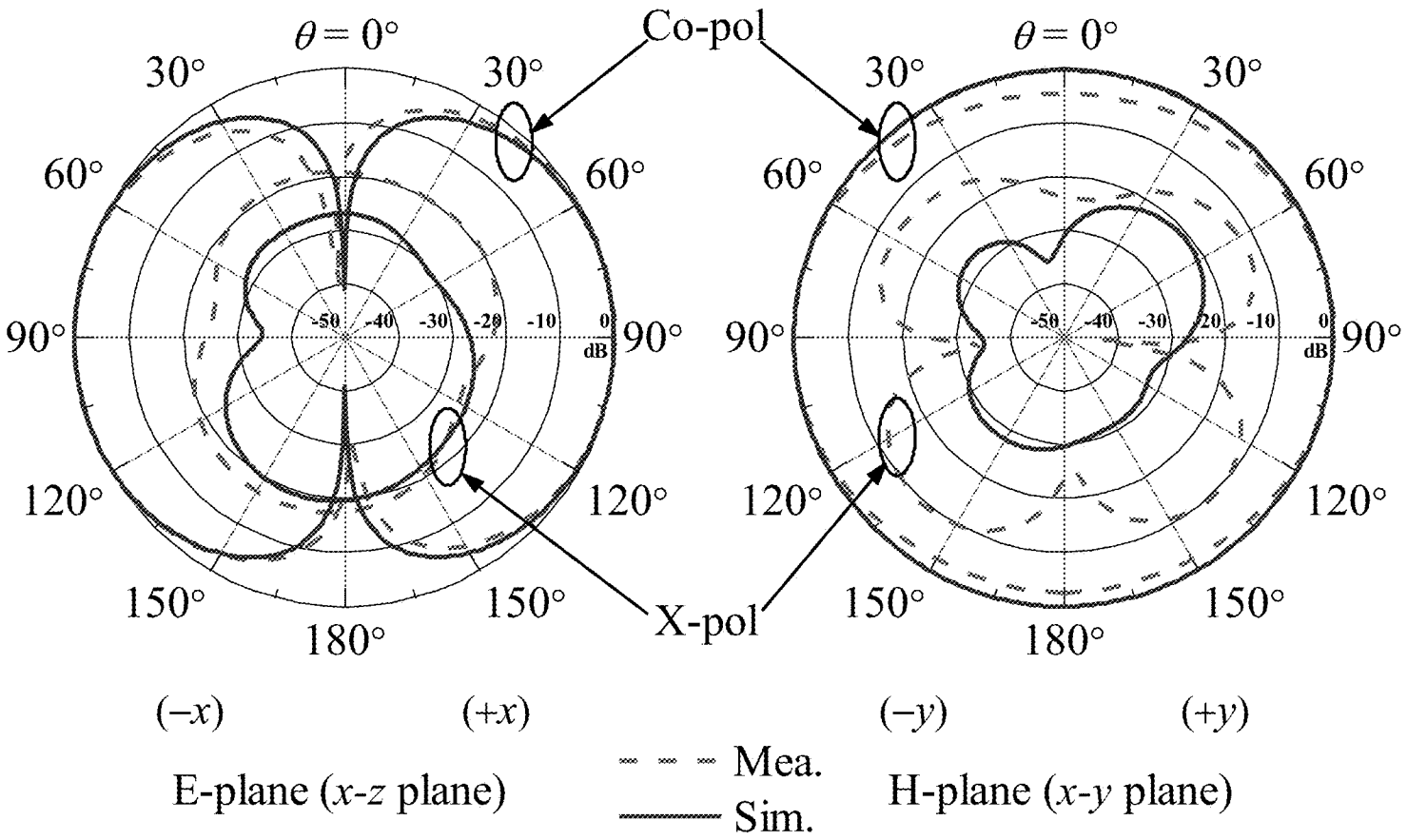
FIG. 4B is a graph showing a second radiation pattern (E-plane and H-plane, measured and simulated, at 2.44 GHz) produced by the dielectric resonator antenna prototype with the substrate assembly of FIG. 2A when connected at a second port (TM port) with a signal source.

The radiation patterns, realized gains, and total efficiencies of the prototype were measured using a Satimo StarLab System. In the measurement test, when one of the TE port and the TM port was under test, the other one of the TE port and the TM port was loaded with a 50-Ω load resistor. FIG. 4 compares the measured and simulated radiation patterns at 2.44 GHz. With reference to FIG. 4A, an omnidirectional radiation pattern can be observed for the TE port. In both of the E- and H-planes, the co-polar fields are higher than the cross-polar fields by at least 15 dB, which is acceptable for practical applications. For the TM port, omnidirectional radiation pattern can also be seen in FIG. 4B. As shown in FIG. 4B, a 15-dB difference between the co-polar and cross-polar fields can be observed in the E-plane. However, the measured cross-polarization gets larger in the H-plane. This is likely due to the measurement problem, and it is envisaged that this problem can be solved or ameliorated using a sleeve balun.

Figure 5:
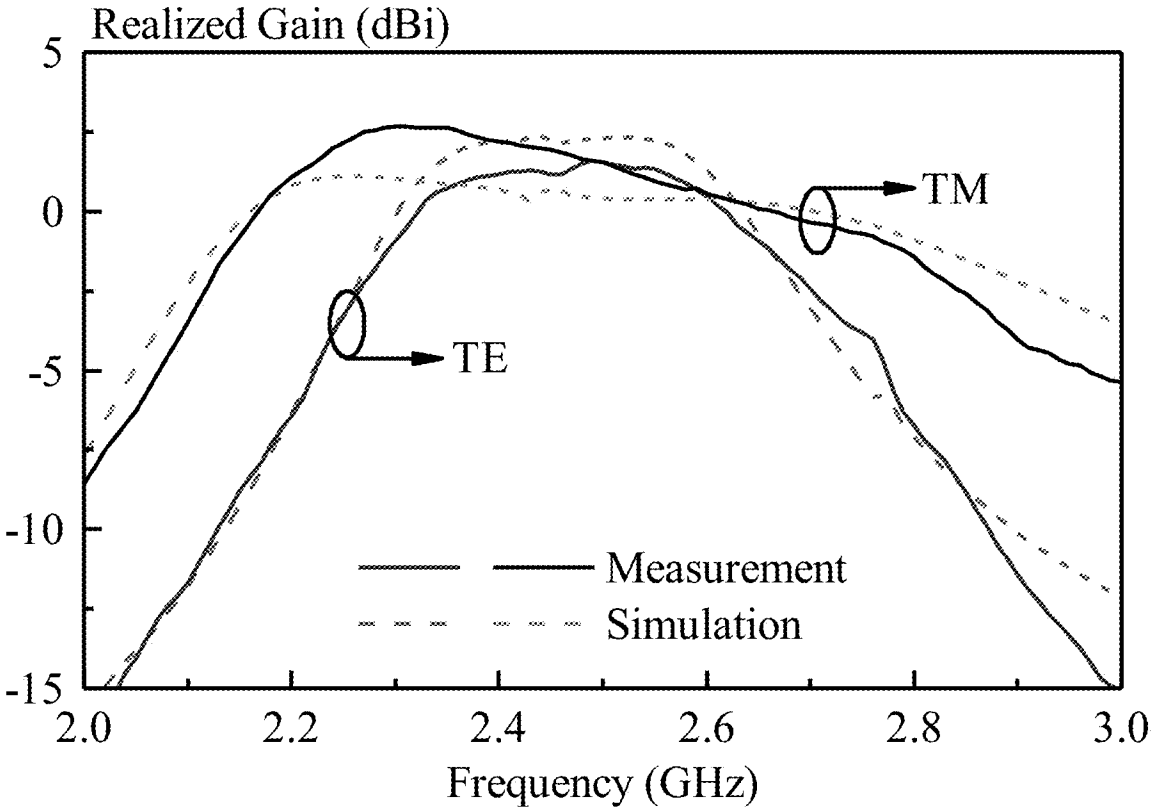
FIG. 5 is a graph showing the measured and simulated realized antenna gain of the dielectric resonator antenna prototype with the substrate assembly of FIG. 2A.

The measured and simulated realized gains of the prototype are shown in FIG. 5. As shown in FIG. 5, the measured and simulated realized gains for the TE port are 1.3 dBi and 2.4 dBi at 2.44 GHz, respectively. Also, within the 2.4-GHz WLAN band, the measured gain is around 0.8 dBi, and the simulated one is around 2.2 dBi. For the TM port, the measured and simulated realized gains at 2.44 GHz are 2.0 dBi and 0.6 dBi, respectively, and they are in turn higher than 1.6 dBi and 0.4 dBi within the WLAN band, respectively.

Figure 6:
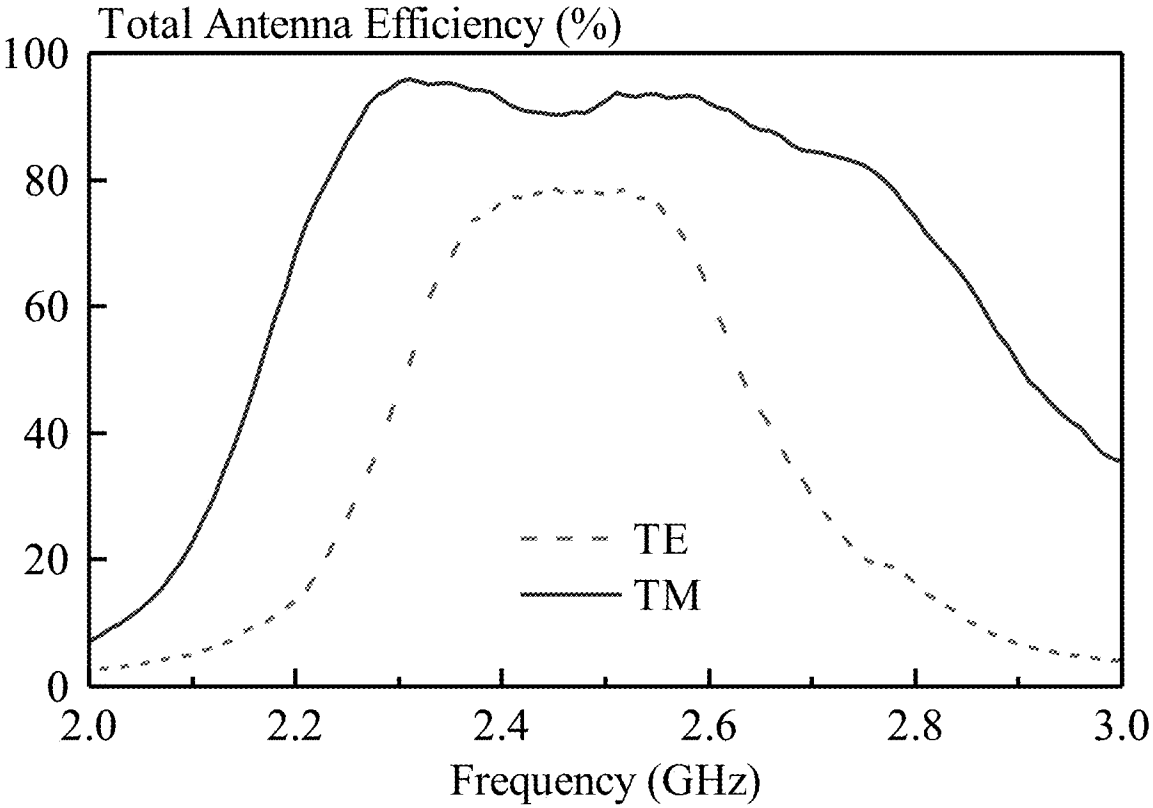
FIG. 6 is a graph showing the measured antenna efficiency of the dielectric resonator antenna prototype with the substrate assembly of FIG. 2A.

The measured total efficiencies of the prototype are given in FIG. 6. The matching levels (see FIG. 3) have been considered in the total efficiencies. As shown in FIG. 6, the measured efficiencies for the TE and TM ports are higher than 75% and 90%, respectively, at the 2.4-GHz WLAN band.

The dielectric resonator antennas in the above embodiments are versatile, efficient, and can provide a high antenna gain. The dielectric resonator antenna can be used in transmitting or receiving end to provide two linearly polarized omnidirectional radiation patterns with polarization diversity. This is useful for eliminating multi-path issues and increasing channel capacity, and is especially suited for indoor communications applications, such as in a Wi-Fi router. In some embodiments, the dielectric resonator antennas can be for polarization diversity. By using one resonator only, cost and size can be effectively reduced as compared with for spatial diversity. The low isolation and correlation of the antennas is suited for use in polarization diversity. The dielectric resonator antennas in the above embodiments employ two different dielectric resonator modes and have two omnidirectional radiation patterns, which is desirable for, e.g. indoor communications. The solid dielectric resonator element can be made and assembled easily and cheaply. The dielectric resonator antennas, being linearly polarized antennas, can be easily integrated with various communication devices. Particularly suitable is indoor communications device, which often require linearly polarized antenna instead of circularly polarized antenna (that will only receive a maximum of a half the radiated energy). In some examples, the dielectric resonator element can be made with commercially-available glass, which can be integrated with kinds of devices, such as light cover, mirror, decoration, and other optical-transparent devices. When a transparent or translucent material is used, the antenna can be easily integrated with different optical devices, e.g. light cover. The material and the shape of the dielectric resonator element can be chosen arbitrarily depending on application, making the design flexible.

Multiple such dielectric resonator antennas of the invention can be integrated to form a MIMO antenna. The dielectric resonator antenna and/or the MIMO antenna of the invention can be integrated or otherwise used in a communication device.

It will be appreciated by persons skilled in the art that numerous variations and/or modifications may be made to the invention as shown in the specific embodiments without departing from the spirit or scope of the invention as broadly described. The described embodiments of the invention should therefore be considered in all respects as illustrative, not restrictive.

For example, the dielectric resonator antenna can be applied for spatial diversity instead of polarization diversity. The dielectric resonator antenna may provide different dielectric resonator modes (not limited to $TE_{011+\delta}$ and $TM_{01\delta}$ modes) that provide different omnidirectional radiation patterns, in particular linearly-polarized omnidirectional radiation patterns. The dielectric resonator modes may alternatively be other antenna modes such as monopole antenna mode or loop antenna mode.

The substrate assembly can take different shape, form, and size (need not be cylindrical). The substrate assembly can have two or more substrate layers. The arrangement of the feeding network can be arranged at different positions in the substrate assembly, and it can be constructed differently. Likewise, the ground plane and the microstrip line network can be arranged at different positions in the substrate assembly, or can be constructed differently. The feeding network and microstrip line network may be formed by etching. The substrate assembly may be removably attached to the dielectric resonator element. The dielectric resonator element need not be made with K9 optical glass, and can be made of any dielectric material with different dielectric constants $\varepsilon_r$. The dielectric resonator element can take different shape, form, and size (need not be cylindrical).

The invention claimed is:

1. A dielectric resonator antenna, comprising:

a dielectric resonator element; and a substrate assembly attached to the dielectric resonator element;

wherein the substrate assembly comprising a feeding network arranged to:

feed the dielectric resonator element to produce a first linearly-polarized omnidirectional radiation pattern at a first resonant mode; and feed the dielectric resonator element to produce a second linearly-polarized omnidirectional radiation pattern at a second resonant mode different from the first resonant mode.

2. The dielectric resonator antenna of claim 1, wherein the first resonant mode is transverse magnetic (TM) mode.

3. The dielectric resonator antenna of claim 1, wherein the second resonant mode is transverse electric (TE) mode.

4. The dielectric resonator antenna of claim 1, wherein the first resonant mode is transverse magnetic (TM) mode and the second resonant mode is transverse electric (TE) mode.

5. The dielectric resonator antenna of claim 1, wherein the substrate assembly comprises a first substrate layer and a second substrate layer, and wherein the first substrate layer is arranged between the dielectric resonator element and the second substrate layer.

6. The dielectric resonator antenna of claim 5, wherein the feeding network is arranged between the first substrate layer and the dielectric resonator element.

7. The dielectric resonator antenna of claim 6, wherein the substrate assembly further comprises a ground plane arranged between the first and second substrate layers and being operably connected with the feeding network.

8. The dielectric resonator antenna of claim 7, wherein the substrate assembly further comprises a microstrip line network arranged on the second substrate layer on a side opposite to the ground plane, the microstrip line network being operably connected with the feeding network.

9. The dielectric resonator antenna of claim 8, wherein the substrate assembly further comprises a feed probe extending through the first and second substrate layers, the feed probe is arranged to operably connect the feeding network with the microstrip line network.

10. The dielectric resonator antenna of claim 9, wherein the feed network comprises:

a first network portion arranged to feed the dielectric resonator element to produce the first linearly-polarized omnidirectional radiation pattern; and a second network portion arranged to feed the dielectric resonator element to produce the second linearly-polarized omnidirectional radiation pattern.

11. The dielectric resonator antenna of claim 10, wherein the first network portion comprises a patch operably connected with the ground plane and the microstrip line network.

12. The dielectric resonator antenna of claim 11, wherein the microstrip line network includes a first microstrip line for connection with a first probe, and wherein the patch is operably connected with the ground plane and with the first microstrip line.

13. The dielectric resonator antenna of claim 12, wherein the patch is connected with the first microstrip line through the feed probe.

14. The dielectric resonator antenna of claim 13, wherein the feed probe is connected to a center of the patch.

15. The dielectric resonator antenna of claim 11, wherein the patch includes a central circular portion and a plurality of radially extending portions extending from the central circular portion.

16. The dielectric resonator antenna of claim 15, wherein each of the plurality of radially extending portions is connected to the ground plane through a respective via that extends through the first substrate layer.

17. The dielectric resonator antenna of claim 15, wherein the radially extending portions are angularly spaced apart evenly.

18. The dielectric resonator antenna of claim 10, wherein the second network portion comprises a plurality of arc-shaped patches arranged on a circular trajectory, the plurality of arc-shaped patches being operably connected with the ground plane and the microstrip line network.

19. The dielectric resonator antenna of claim 18, wherein the microstrip line network includes a power combining-dividing network and a second microstrip line for connection with a second probe.

20. The dielectric resonator antenna of claim 19, wherein the power combining-dividing network comprises a plurality of sections each corresponding to a respective arc-shaped patch and a combining section connecting the plurality of sections.

21. The dielectric resonator antenna of claim 20, wherein each of the plurality of sections and the respective arc-shaped patch are connected through a respective via that extends through the first and second substrate layers.

22. The dielectric resonator antenna of claim 18, wherein the plurality of arc-shaped patches are angularly spaced apart evenly.

23. The dielectric resonator antenna of claim 1, wherein the dielectric resonator element is a solid element.

24. The dielectric resonator antenna of claim 1, wherein the dielectric resonator element is substantially transparent.

25. A multiple-input and multiple-output (MIMO) antenna comprising a plurality of dielectric resonator antennas of claim 1.

26. A wireless communication device comprising the dielectric resonator antenna of claim 1.

* * * * *